US009095861B2

(12) United States Patent
Costello

(10) Patent No.: US 9,095,861 B2
(45) Date of Patent: Aug. 4, 2015

(54) DUAL SHOWER HEAD ASSEMBLY

(71) Applicant: John Costello, Jacksonville, FL (US)

(72) Inventor: John Costello, Jacksonville, FL (US)

( * ) Notice: Subject to any disclaimer, the term of this patent is extended or adjusted under 35 U.S.C. 154(b) by 160 days.

(21) Appl. No.: 13/967,034

(22) Filed: Aug. 14, 2013

(65) Prior Publication Data

US 2015/0048181 A1 Feb. 19, 2015

(51) Int. Cl.

| | |
|---|---|
| ***B05B 15/08*** | (2006.01) |
| ***B05B 1/18*** | (2006.01) |
| ***E03C 1/04*** | (2006.01) |
| ***E03C 1/06*** | (2006.01) |

(52) U.S. Cl.

CPC ..... *B05B 1/185* (2013.01); *E03C 1/0408* (2013.01); *E03C 1/06* (2013.01)

(58) Field of Classification Search

CPC ..... B05B 15/66; B05B 15/069; B05B 15/08; B05B 15/10; B05B 1/185; B05B 1/20; B05B 1/202; B05B 1/205; B05B 1/30; B05B 1/32; A01G 25/097; E03C 1/025

USPC ..... 239/200, 22.11, 267, 444, 222.11, 437, 239/438, 443; 4/601, 607, 615

See application file for complete search history.

(56) References Cited

U.S. PATENT DOCUMENTS

| | | | | | |
|---|---|---|---|---|---|
| 4,561,136 | A | * | 12/1985 | Baer | 4/615 |
| 5,564,139 | A | * | 10/1996 | Shorr | 4/601 |
| 5,799,346 | A | * | 9/1998 | Tiernan | 4/601 |

* cited by examiner

*Primary Examiner* — Justin Jonaitis
*Assistant Examiner* — Joseph A Greenlund
(74) *Attorney, Agent, or Firm* — Lawrence J. Gibney, Jr.

(57) ABSTRACT

Because the height of humans will vary it is important to be able to adjust the height of the showerhead. At times it may also be useful to be able to have two people shower at the same time and be able to adjust the distance between the two showerhead to accommodate the distance between two people. It may also be useful for the showerhead to be portable and easily attached and reattached to the water supply for the shower.

4 Claims, 5 Drawing Sheets

DUAL SHOWER HEAD ASSEMBLY

BACKGROUND OF THE INVENTION

This is a continuation in part from a previously filed application with the Ser. No. 12/708,833 and a filing date of May 1, 2012. The undersigned is claiming the priority filing date based on the earlier filed application.

A. Field of the Invention

This relates to enabling more than one individual to take a shower at the same time, using one shower bar. It also provides a height adjustment for the shower bar, as well as swivel showerheads for ease and comfort of use. In addition to swiveling, the showerheads are capable of being horizontally positioned along the bar. With this device people who need to raise the height of the shower as well as people who need to sit when in the shower can be accommodated.

B. Prior Art

There are many prior art references to showerheads, but there are few that teach dual shower attachment devices. A representative example of this type of device in the prior art can found at Shorr, U.S. patent application publication 2007/0209108 and Shorr U.S. Pat. No. 5,564,139. Although both devices are dual showerhead assemblies, the both require permanent assembly or permanent modifications to the walls of the shower. In 139 the shower bar is screwed into the pressurized water supply and thereby fastened to the wall on one end of the shower bar. The other end of the shower bar rests on a block which is attached to the opposite wall of the shower.

The 108 application allows for the shower bar to be adjusted vertically, but requires permanent modifications to the shower walls. 108 teaches a pair of brackets which are installed on opposite walls of the shower enclosure. Each bracket has incremental holes placed so that the bar can be moved to different heights.

The current invention differs from both forms of prior art because it allows for the user to adjust the shower bar's height without making any permanent modifications to the shower enclosure.

BRIEF SUMMARY OF THE INVENTION

In certain circumstances, it may become desirable to have a dual showerhead assembly. This may be because multiple individuals may wish to use a shower at the same time.

Additionally, there is a problem of height in some showers. Taller people may find it difficult to shower in a traditional shower and this device provides a way to adjust the height of the showerhead. Conversely, if the person needs to sit during a shower this device can be adjusted to a comfortable height for that individual as well.

This device is not a permanent attachment to the shower and requires no permanent modifications to the shower enclosure. Instead, this device can be removed as needed by the user of the shower. Additionally, this device does not use the existing showerhead but instead replaces the existing showerhead with separate showerheads that can be operated independently of each other. The showerheads can also be independently moved horizontally along the shower bar.

Additionally, at the end, in order to prevent the device from falling, there will be a plate with a slight protrusion at the end to grip the wall. surface. This plate member is threaded on the end of the rod and the device can expand three and one half feet at each end to insure that this device works on all sized showers. When the shower surface gets wet, the plate with the protrusion at the ends of the device prevent the device from slipping.

BRIEF DESCRIPTIONS OF THE DRAWINGS

NUMBERING DESCRIPTION

5—Device
10—Shower Rod
12—First Interior Cylindrical Pipe
13—Second Interior Cylindrical Pipe
14—Cap
15—Showerhead
20—Valve
25—Slot
29—Water Line from House
30—Interior Flexible Hose
31—Interior Water Source
35—Rubber Washer
40—Protrusion
45—Rubber Stopper

DETAILED DESCRIPTION OF THE EMBODIMENTS

Figure 1:
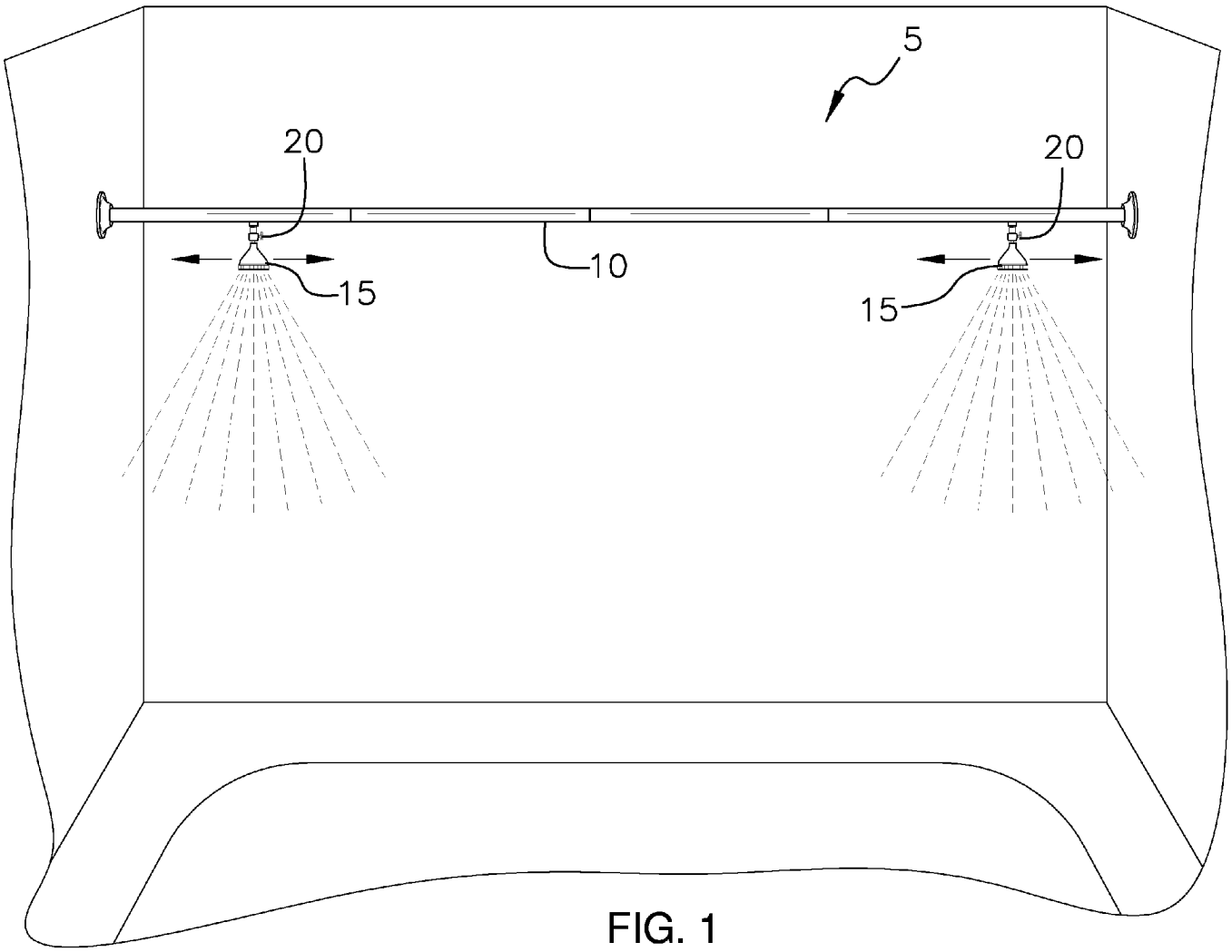
FIG. 1 is a frontal view of the device in use depicting the first embodiment.

In order to permit more than one person to shower at a predetermined height this device 5 is placed in a shower as depicted in FIG. 1. It should be noted that although the following embodiments only describe the shower bar comprising two showerheads, it has been contemplated that there may be more or less than two showerheads utilized in this device.

The device 5 will be comprised of a shower rod 10 through which a first interior cylindrical pipe 12 and second interior cylindrical pipe 13 are placed. The first interior cylindrical pipe 12 is positioned closer to the end of the shower rod 10 where the water is supplied through the interior water source 31 coming from the home. The interior water source 31 is connected to the water line from the house 29. Water will flow from the interior water source 31 to the first interior cylindrical pipe 12 that is positioned inside the shower rod 10. However, an additional interior flexible hose could attach the interior water source 31 to the first interior cylindrical pipe. The first interior cylindrical pipe 12 is connected to the second interior cylindrical pipe 13 by an interior flexible hose 30. Attached to the interior cylindrical pipe is a showerhead 15.

Water will be permitted to flow through the interior water source 31, the first interior cylindrical pipe 12, the interior flexible hose 30, the second interior cylindrical pipe 13, and the showerhead(s) 15 respectively, to bathe the person(s) taking the shower.

Each of the showerheads 15 will have a means to regulate the flow of water through each showerhead 15, independent of each other. Each showerhead 15 will have a valve 20, which operates independently of each other. This allows the user the option of using all showerheads or to use one showerhead if he or she desires.

Figure 4:
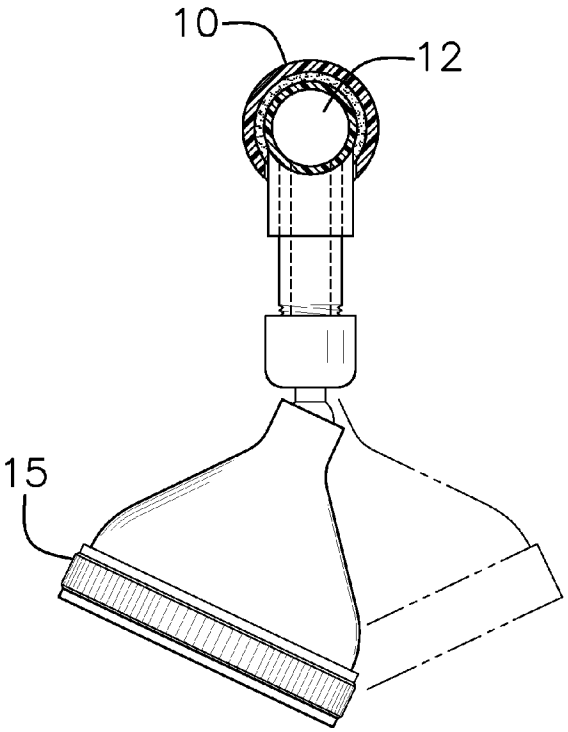
FIG. 4 is a cross-sectional view of the device depicting the section where the showerhead moves horizontally along the bar.

Each of the showerheads 15 will have the ability to swivel so that the individual can direct the flow of water as desired, as depicted in FIG. 4.

Figure 2:
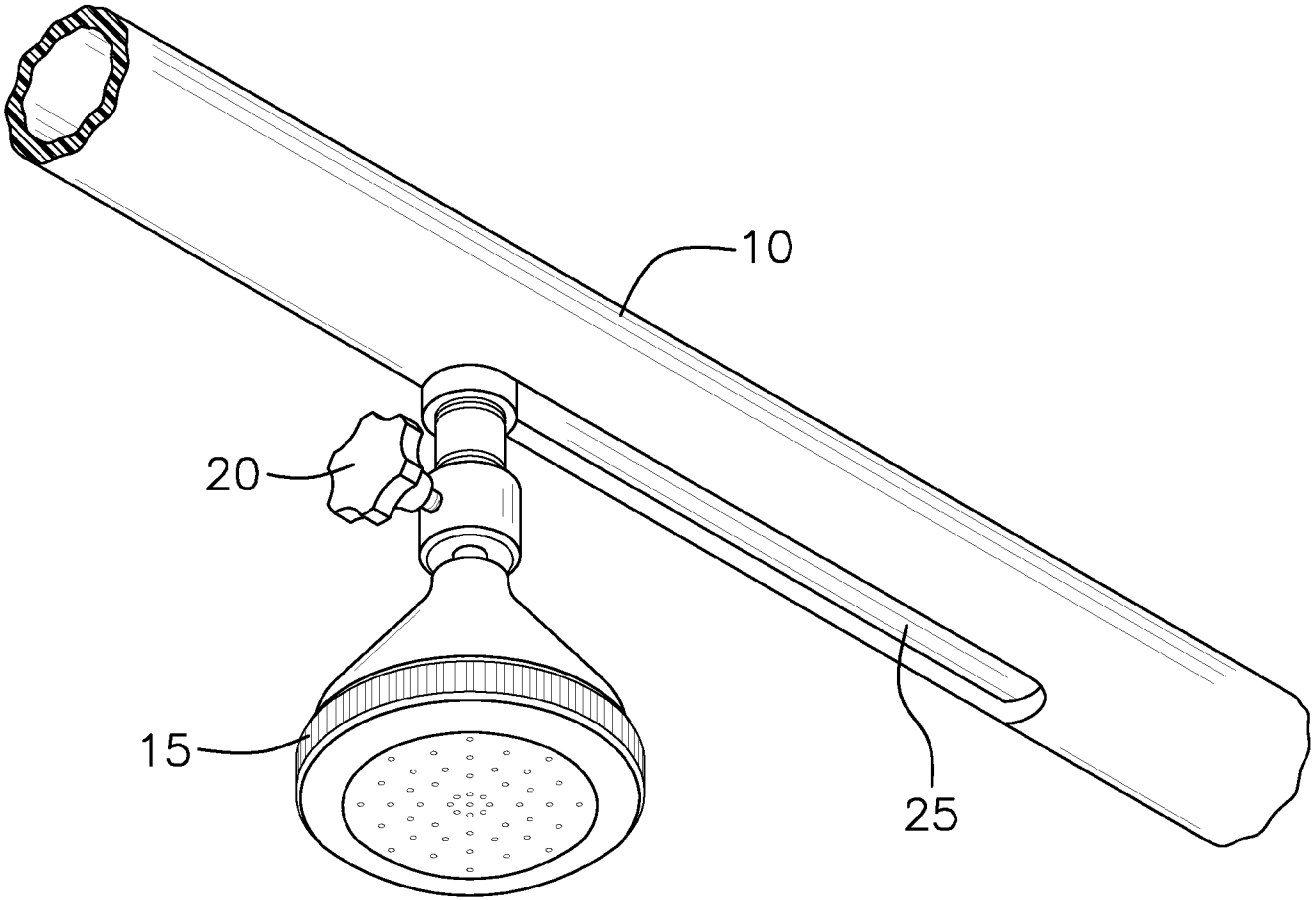
FIG. 2 is a fragmented isometric view of the outside of the device depicting the area where the showerheads can move horizontally along the bar.
Figure 3:
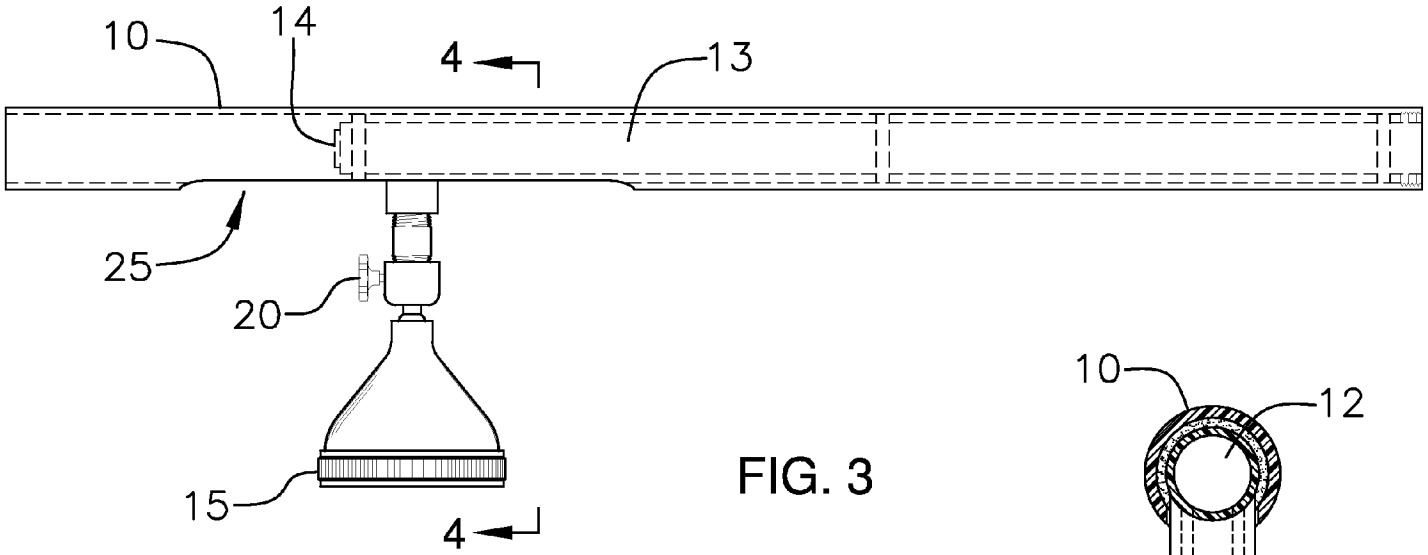
FIG. 3 is a fragmented frontal view of the inside of the device depicting the area where the showerhead can move horizontally along the bar

In addition to swiveling, each of the showerheads 15 will have a means to move horizontally along the shower rod 10. The shower rod 10 will contain a plurality of slots 25 of a predetermined length. Each interior cylindrical pipe 12, 13 will have a nipple which a showerhead will connect to. The nipple is placed through the slot 25 as depicted in FIG. 2 and FIG. 3. The showerhead can then be moved along the slot 25 in the shower rod 10. The interior flexible hose 30 within the interior of the device permits the horizontal movement of the interior cylindrical pipe and thus, the showerhead so that the person can position the spray of water as desired.

To insure the showerheads remain in the user's desired position there are rubber washers 35 placed around each interior cylindrical pipe. The rubber washers 35 will create a snug fit between the outer surface of the interior cylindrical pipe 12 and 13 and the interior surface of the shower rod 10.

In order to insure that the device will remain secured to the sides of the shower, a plate with a protrusion 40 will be placed on each end of the rod. The plates will be internally threaded to match the threads on the end of the rod so that the person using the device can expand the device to a desired length. The protrusions 40 will not damage the surface of the shower. A means to lengthen the shower rod is also provided; these methods are commonly found in the prior art currently and no particular means is being provided.

A protrusion 40 on the surface of the respective ends of the plate(s) will allow the device to grip the shower surface, which is likely to be made from ceramic, porcelain, tile or sheetrock. This device is not intended to be a permanent fixture to the shower and can be easily moved from shower to shower as desired.

The shower bar 10 will be equipped with two separate means of connections to the main water supply line, and will be described as two separate embodiments. The first embodiment uses a solid piece such as depicted in FIG. 5 while the second embodiment uses a predetermined piece of flexible hose; in both embodiments the device is connected to the water source line 29.

The advantage to the second embodiment is that there is more opportunity to adjust the device vertically.

First Embodiment

Figure 5:
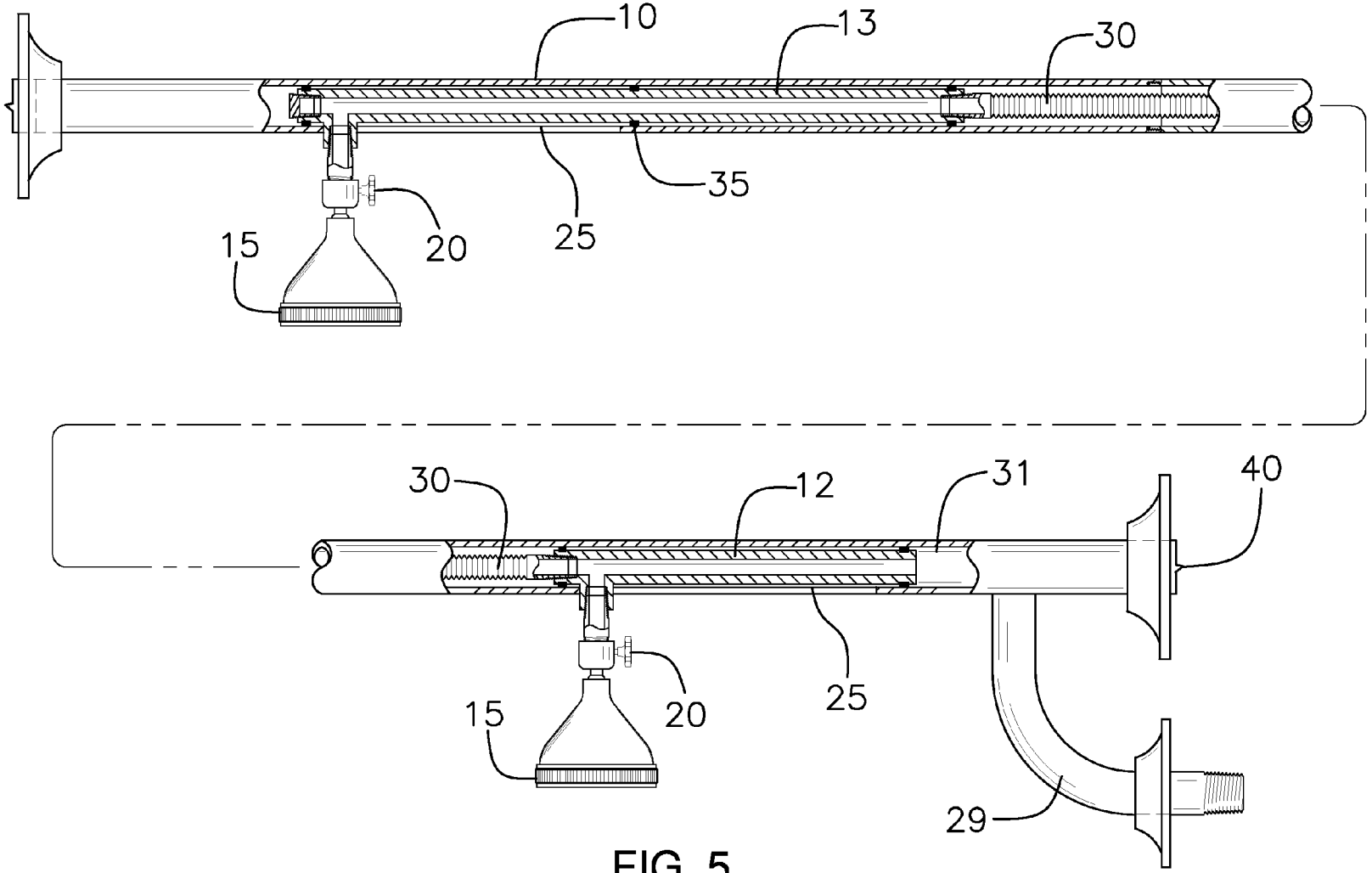
FIG. 5 is an exploded view showing the interior components of the device.

For the first embodiment the means of connection to the shower line will likely comprise of a solid piece 29 exiting the shower rod 10 at one end to directly connect to the water source coming from the house as depicted in FIG. 5. The other end of the fixed piece 29 will, connect to the interior water source line 31.

In use the water will flow out from the existing water pipe through the water line from the house 29 into the interior water source 31, first interior cylindrical pipe 12, the interior flexible hose 30, the second interior cylindrical pipe 13, and through the showerheads 15 respectively.

This embodiment is meant to allow a user to modify a single person shower into a single or multi-person shower without requiring any modifications to the shower enclosure.

Second Embodiment

For the second embodiment, the means of connection to the shower line will likely be an exterior flexible hose 29 that is attached at one end to the line for the existing water supply for the shower and at the other to the device with a coupling or threaded mechanism. The device must be connected to the water supply for the shower while at the same time allowing for the ability to adjust the height of the device. Although there are many types of connection means, no specific means is being claimed in this application.

Figure 6:
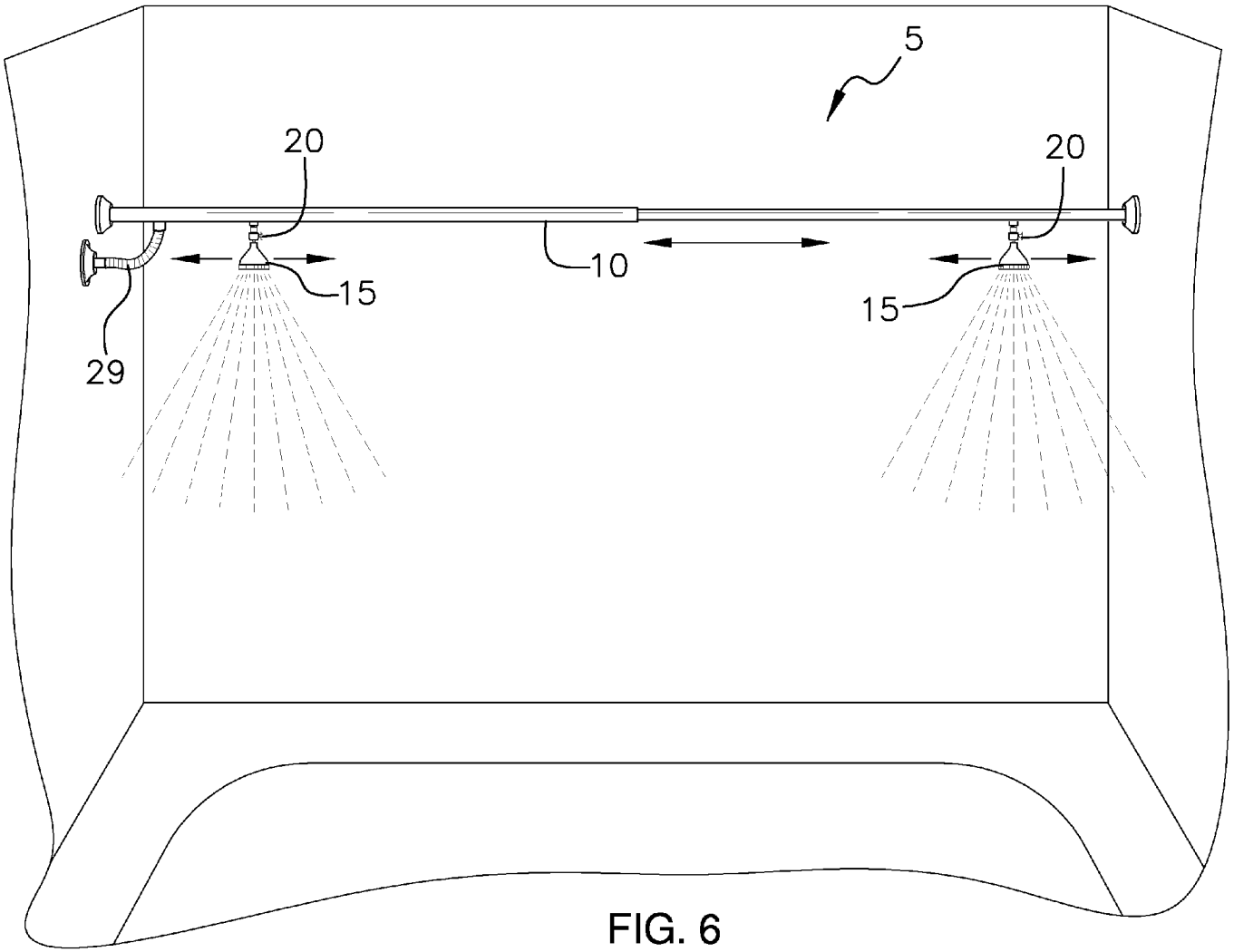
FIG. 6 is a front view of the device depicting the second embodiment.

In use the water will flow from the existing shower pipe through the exterior flexible hose 29 into the interior water source 31 as depicted in FIG. 6. The water will then flow through the interior of the device like the first embodiment; the only difference between the two embodiments is the means of connection to the water source. In this embodiment the showerhead would be placed at a desired height and positioned above the person in the shower and the flexible water line from the house 29 allows greater flexibility in that regard.

Because this device is connected to the main water supply for the shower, the height of the device can be adjusted easily up and down depending on the particular needs of the user. The first interior cylindrical pipe 12 and second interior cylindrical pipe 13 within the shower rod along with the showerheads 15 can be moved to adjust the direction of the flow of water.

Although the application describes this device as a means by which a taller person can enjoy a shower, the device may also be used with individuals who are shorter in terms of adjusting the height of the rod to an adjustable height. It can also be used with persons who need to sit during a shower so that the water is comfortable on the person while the person is taking a shower.

While the embodiments of the invention have been disclosed, certain modifications may be made by those skilled in the art to modify the invention without departing from the spirit of the invention.

The inventor claims:

1. A dual showerhead assembly comprised of:

a. a shower rod;

wherein the shower rod is hollow;

wherein a means to connect the shower rod to the shower surface is provided;

wherein there is a means of lengthening the shower rod;

wherein the shower rod has a first end and a second end;

wherein a plurality of slots are provided on the surface of the shower rod;

said plurality of slots permit the movement of the showerheads in a horizontal direction for a predetermined length;

b. an interior water source;

wherein the interior water source is secured to a water supply for the shower;

c. a first interior cylindrical pipe;

wherein the first interior cylindrical pipe has a first end and a second end;

wherein the first end of said first interior cylindrical pipe is connected to the interior water source;

wherein the second end of the first interior cylindrical pipe is connected to an interior flexible hose;

wherein the first interior cylindrical pipe may connect to a shower head;

wherein the first interior cylindrical pipe is of a predetermined length;

d. a second interior cylindrical pipe;

wherein the second interior cylindrical pipe is connected to the interior flexible hose;

wherein the second interior cylindrical pipe is a predetermined length;

wherein the flow of water from the first interior cylindrical pipe travels through the interior flexible hose and then through the second interior cylindrical pipe;

wherein the second interior cylindrical pipe slides in a horizontal direction;

wherein the second interior cylindrical pipe may connect to a showerhead;

wherein the second interior cylindrical pipe is of a predetermined length;

wherein a cap is placed at the second end of said second interior cylindrical pipe;

wherein the cap prevents water from flowing through the second end of the second interior cylindrical pipe;

f. dual showerheads;

wherein the dual showerheads have a first end and a second end;

wherein the first ends of said dual showerheads are connected to the first interior cylindrical pipe and second interior cylindrical pipe;

wherein a means to regulate the flow of water through the dual showerheads is provided;

wherein the dual showerheads can be adjusted to alter the direction of the flow through the showerhead;

wherein said showerheads operate independently of each other;

g. a plurality of rubber washers;

wherein the plurality of rubber washers is placed around exterior surface of the first and second interior cylindrical pipes within the shower rod;

said plurality of rubber washer maintain a snug fit of the first interior cylindrical pipe and second interior cylindrical pipe within the shower rod.

2. A dual showerhead assembly as described in claim 1 wherein the means to connect the device to the water supply for the shower is a solid piece.

3. A dual showerhead assembly as described in claim 1 wherein the means to connect the shower rod to the shower surface is a flexible piece.

4. A dual showerhead assembly as described in claim 3 wherein the means to connect the shower rod is expandable.

* * * * *